US005374233A

United States Patent [19]

Lehmann et al.

[11] Patent Number: 5,374,233

[45] Date of Patent: * Dec. 20, 1994

[54] BUCKLING-TYPE PAPER SHEET FOLDER WITH PROTECTIVE HOUSING

[75] Inventors: Werner Lehmann, Gutach; Rainer Fecker, Furtwangen; Wilhelm Markgraf, Tennenbronn; Manfred Fuss, St. Georgen/Schw., all of Germany

[73] Assignee: Mathias Bäuerle GmbH, Germany

[ * ] Notice: The portion of the term of this patent subsequent to Aug. 20, 2005 has been disclaimed.

[21] Appl. No.: 719,345

[22] Filed: Apr. 3, 1985

[30] Foreign Application Priority Data

Apr. 4, 1984 [DE] Germany ..... 3412606

[51] Int. Cl.[5] ..... B31F 1/00

[52] U.S. Cl. ..... 493/421; 493/477; 181/200

[58] Field of Search ..... 493/419, 420, 421, 443, 493/444, 445, 477; 181/200, 202

[56] References Cited

U.S. PATENT DOCUMENTS

| | | | |
|---|---|---|---|
| 2,461,214 | 2/1949 | Holms | 493/421 |
| 3,516,655 | 6/1970 | Schmeck | 493/421 |
| 3,856,293 | 12/1974 | Boyer | 493/421 |
| 4,336,862 | 6/1982 | Adam et al. | 493/420 |

FOREIGN PATENT DOCUMENTS

| | | | |
|---|---|---|---|
| 2357247 | 5/1974 | Germany | 181/201 |
| 3027344 | 12/1980 | Germany | 493/421 |
| 3025239 | 5/1983 | Germany | 493/421 |
| 435322 | of 0000 | Switzerland | 493/421 |
| 1245133 | 9/1971 | United Kingdom | 493/421 |

OTHER PUBLICATIONS

"Multi-effekt" A New Generation of Folding Machines for Bookbinding Shops, Jan. 1976, pp. 12–17.

*Primary Examiner*—Francis S. Husar
*Assistant Examiner*—David B. Jones
*Attorney, Agent, or Firm*—McGlew and Tuttle

[57] ABSTRACT

A buckling-type paper sheet folder comprises a protective housing (7) and two pairs of folding cylinders (W1, W2, W3, W4) which are mounted in a cylinder frame (1) and conjointly driven by an electric motor (4). Folding pockets (5,6) and the cylinder frame are enclosed on all sides by the housing which has two parts, namely a base (8) and a cover (9), that are hinged and/or detachably connected to each other. In the base, a box-like compartment (12) is formed below the folding pockets accommodating the cylinder frame. The cover comprises a wall (45) extending between vertical side walls (40,41) and covering the upper foldin pocket (5) and having a portion (48) forming the upper boundary of a sheet intake opening. The cover further comprises a second wall (54) extending above the second folding pocket (6) inwardly, to form the lower boundary of the intake opening (51), and having a front portion 39. The parting lines of the vertical housing walls extend at least partly close to the plane of the folding pockets.

16 Claims, 7 Drawing Sheets

BUCKLING-TYPE PAPER SHEET FOLDER WITH PROTECTIVE HOUSING

FIELD AND BACKGROUND OF THE INVENTION

The present invention relates in general to sheet folding devices, and in particular to a new and useful folding machine which includes a protective housing :for containing a plurality of rollers and a pair of pockets which are used in conjunction with each other to twice fold a piece of sheet material such as paper.

Folders of this kind are known (German patents 3,025,239 and 3,027,344). Hood-like multipart housings are provided as protection, especially for feeders that handle large size sheets, to cover the upper parts of the machine and enclose the lower part thereof by a tray-like structure. Hood and pocket shaped envelopes made of sound absorbing or deadening materials, such as hard foam, are also employed with smaller folders,as a protection against noise produced by the machine. Such envelopes are usually either slipped over the folding pockets, or put over the middle part of the machine.

The manufacture of such multipart noise absorbing guards is expensive and in addition, the parts must individually be removed from the machine if the sheet stops are to be adjusted, and then put in place again, which not only is time consuming but also involves the risk of damaging the parts. The same inconvenience is encountered in instances of failure in operation, such as a paper jam.

SUMMARY OF THE INVENTION

The present invention is directed to a feeder of the above mentioned kind having no such drawbacks and being provided with a protective housing which is simpler in manufacture and simpler to handle, better to assemble and more effective in its purpose.

Accordingly, it is an object of the present invention to provide a buckling-type folding machine which comprises a cylinder frame to which are mounted a plurality of folding cylinders which comprise cylinder means for receiving a sheet and supplying it sequentially to two folding pockets, two folding pockets mounted at different levels and on opposite sides of the cylinder frame , each pocket being equipped with a displaceable sheet stop, and a two part housing surrounding the pockets and frame, the housing having a base and a cover pivotally or detachably connected to the base, the base including a box-like compartment for receiving the cylinder frame which compartment is defined between two bottom walls of the folding pockets, the housing base including lateral vertical walls connected to the bottom walls of the pockets, and the cover comprising two vertical side walls, a first cover wall extending over the upper one of the folding pockets and including an interior wall portion projecting downwardly to form the upper portion of an intake opening for receiving sheets into the cylinder means, and a second cover wall extending over the lower one of the pockets and defining a lower edge of the intake opening. A parting line is defined by the engaged cover and base, which extends at least partly close to a plane containing at least one of the folding pockets.

A folding machine thus equipped has the advantage over prior art machines of this kind that the entire protection is provided by a compact housing of only two parts, in which the cylinder frame with the two folding pockets can be accommodated and secured in a manner best suited for operation and making the two folding pockets and the folding cylinders freely acceissible in a simple way and at anytime as needed.

Since the cover is hinged to the base, the housing can easily be opened and closed by simply swinging the cover.

another important feature is that the wall portions bounding the intake opening and the discharge opening extend or terminate close to a folding cylinder or a conveying roller. This insures that as little noise as possible penetrates from the inside to the ambience through these unavoidable openings. The cylinders which can be provided with rubber or foam coatings, advantageously contribute to noise suppression. However, it is not absolutely necessary to provide the respective cylinders or rollers with such coatings.

An advantageous development of the invention provides that the second cover wall slopes from the intake opening upwardly toward an exterior of the housing and supports a feed table thereon, and that the second cover wall includes a trough-like recess for receiving a sheet feeder therein. This makes it possible to provide a sheet separator or sheet feeder for individually advancing the lowermost sheets of a stack. For this purpose, the separator or feeder must be mounted below the plane of the feed table.

Another object of the invention is to provide such a machine wherein the two folding pockets with their two bottom walls, slope at least approximately at equal angles with respect to the cylinder frame, the upper folding pocket sloping upwardly toward one side of the housing and the lower folding pocket sloping downwardly toward an opposite side of the housing. This makes the machine substantially symmetrical with respect to the median vertical plane, and leaves enough space for accommodating a delivery table or a sheet conveying means.

A further object of the invention is to provide such a folding machine wherein the base has an interior rear wall which defines one side of the compartment, which extends downwardly from the bottom wall of the upper folding pocket. The advantage thereof is that the discharge opening thereby comes close to the cylinder frame, so that the sheets have to travel only a very little distance from the last folding line to the delivery table or conveyor.

To minimize that gap of the discharge opening and the distance thereof from the last folding line, another development of the invention provides that to form the discharge opening, the interior rear wall of the base is provided with two wall portions which are inclined and terminate close to cylindrical surfaces of two of the folding cylinders forming the last folding line in a feed path of a sheet to be folded.

Without this provision, it might become necessary to provide a third pair of cylinders between the last folding line and the discharge opening.

A still further object of the invention is to provide such a folding machine wherein the bottom wall of the first folding pocket extends downwardly to the discharge opening, with a sheet feeding conveyor being connected to the base directly adjacent the discharge opening, the base having a second bottom wall extending parallel to the conveyor.

Such conveyor means are usual in the prior art, of course. However, as a rule, the conveyor means are provided outside the housing proper. The invention provides the conveying means directly below the bottom of the first folding pocket, thus inside the housing.

To better master disturbances in operation, particularly paper jams in the folding pockets, another development provides two spaced apart rod lattices extending in parallel one above the other which are hinged and are detachably connected, the stop rail being mounted between the lattices for lengthwise displacement.

According to a further feature of the invention, the upper one of the rod lattices of each of the folding pockets is secured to the cover of the housing while the lower rod lattice carries the stop rail and is supported by the base.

The advantage of this design is that the folding pockets are then opened simultaneously with the housing.

To make it unnecessary to open the housing anytime the stop rails are to be adjusted to another sheet size and/or manner of folding, a development of the invention provides that the stop rail of both of the folding pockets are connected each to endless draw members, such as chains or belts, which extend parallel to a plane of the respective folding pocket and are engaged around drive and tail rollers which are carried by common drive shafts and provided with a turning member which is actuatable from an outside of the housing.

This makes it possible to adjust the position of the stop rails in both of the folding pockets independently of each other and very easily from the outside, with the housing closed, by simply actuating the turning members, such as turning knobs. At the same time, the stop rails may be equipped with pointers which extend to the outside and move along a scale which is provided on the outside of the housing and on which the respective positions of the stop rail can be read.

Scales are provided which extend along each of the folding pockets and are disposed in window-like recesses so that they can be read from outside the housing. A pointer is associated with each stop rail and can be read in conjunction with a respective scale for showing the position of the stop rails. Then, the position of the stop rail can be read and determined by means of the pointer moving close behind the scale. No opening for the pointer is needed in such a case. The housing may remain completely closed at this location, thus better serve its protective purpose.

To prevent the stop rails from undesirably varying their adjusted position, it is provided that turning members connected to the shafts can be held in fixed positions by a brake mechanism.

In a most simple design, such a mechanism may comprise a set screw engaged in a tap hole of the housing and radially pressed against the shaft or the turning member, or a screw in an eccentric tap hole of the turning member and, with the position of the turning member set, pressed against the outside of the housing.

In accordance with another feature of the invention, at least one of the vertical side walls of the base is provided with a recess between the bottom wall defining the first pocket, and the conveyor. This offers the advantageous possibility of directly watching the sheets leaving the discharge opening.

A further object of the invention is to provide a folding machine with a novel housing which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the following various embodiments of the invention are explained in more detail with reference to the drawings in which.

DESCRIPTION OF THE PREFERRED EMBODIMENTS

Figure 1:
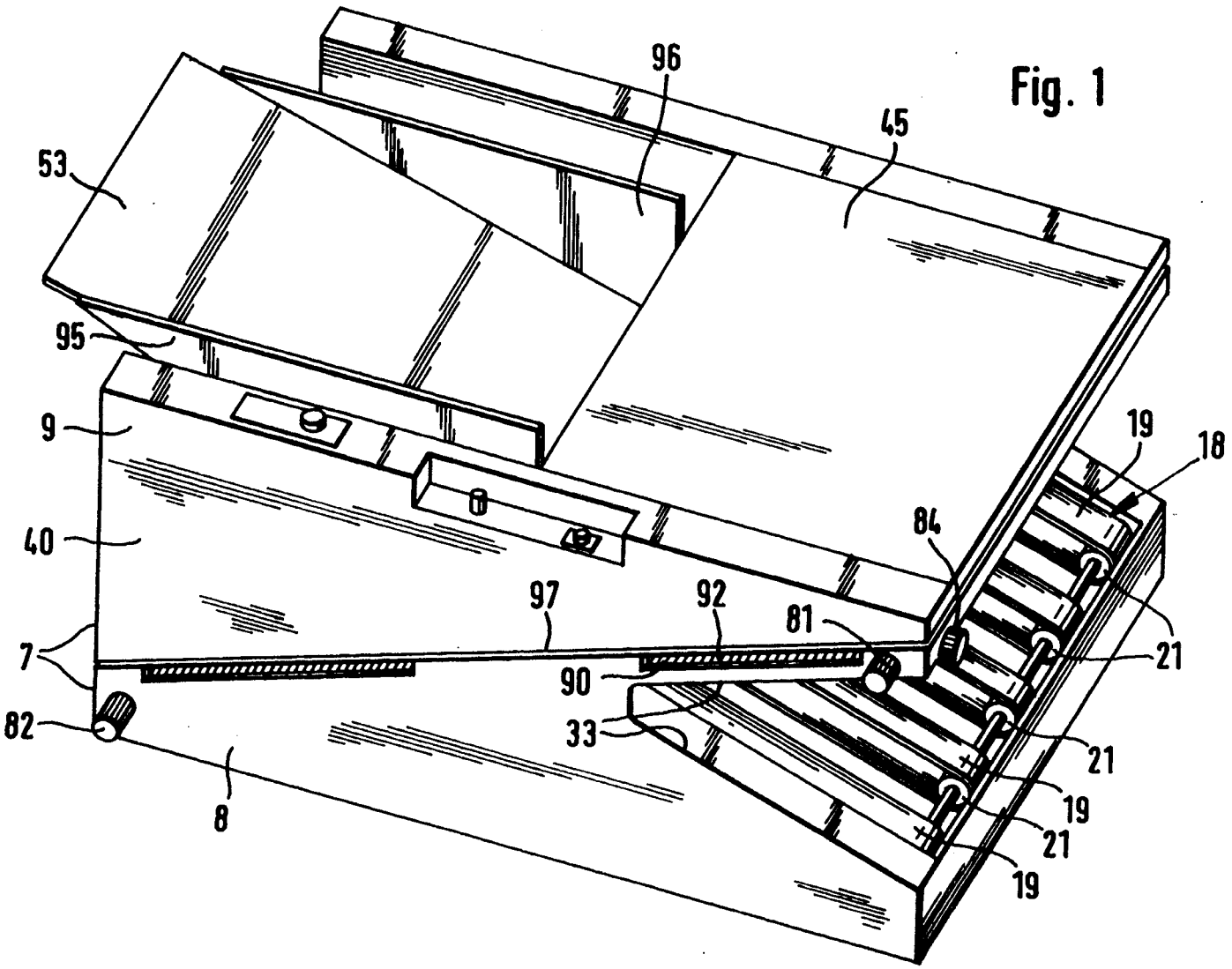
FIG. 1 is a perspective view of a buckling-type sheet folder machine.
Figure 2:
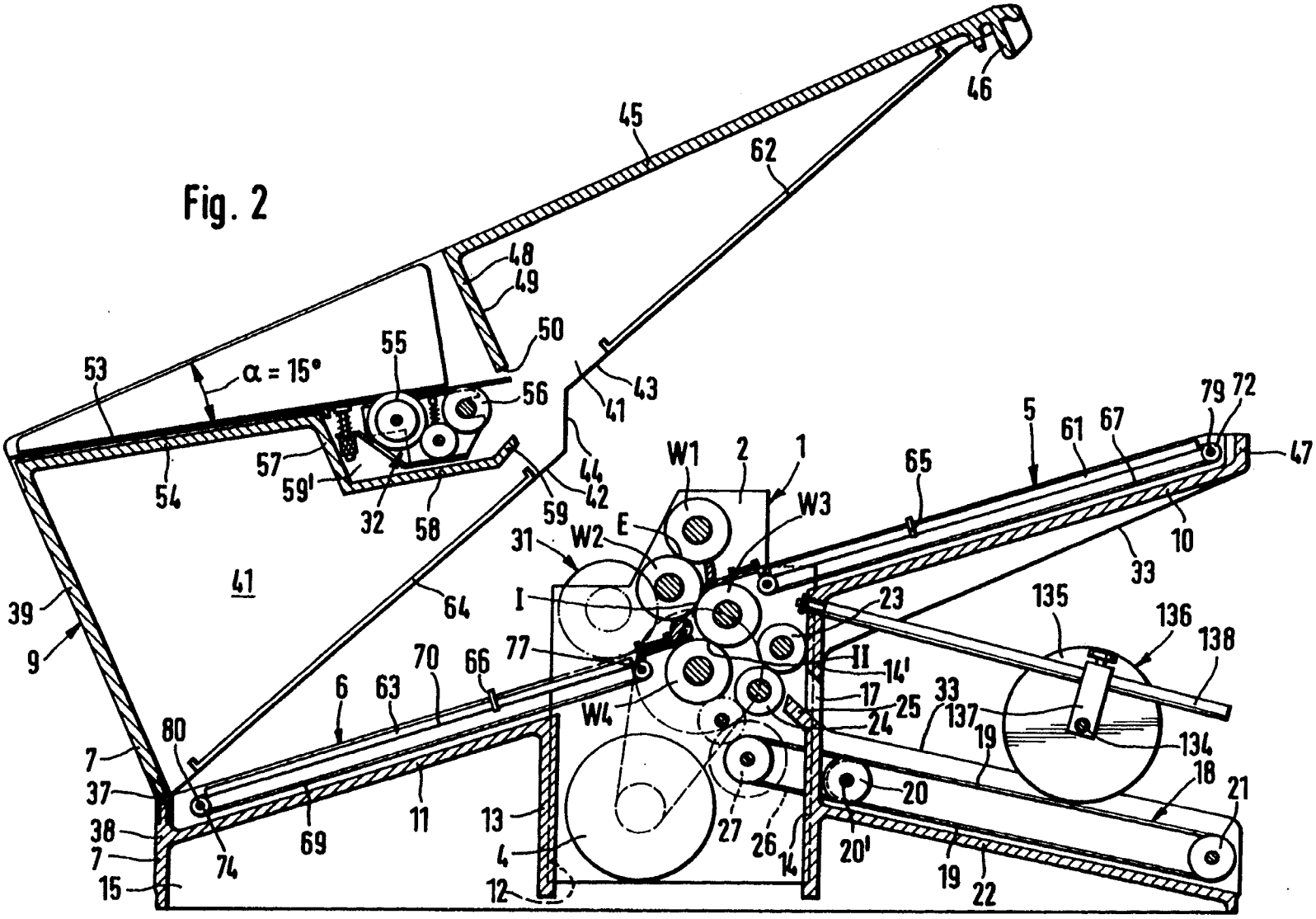
FIG. 2 is a vertical sectional view of a machine similar to the one shown in FIG. 1 with the housing partly swung open.
Figure 5:
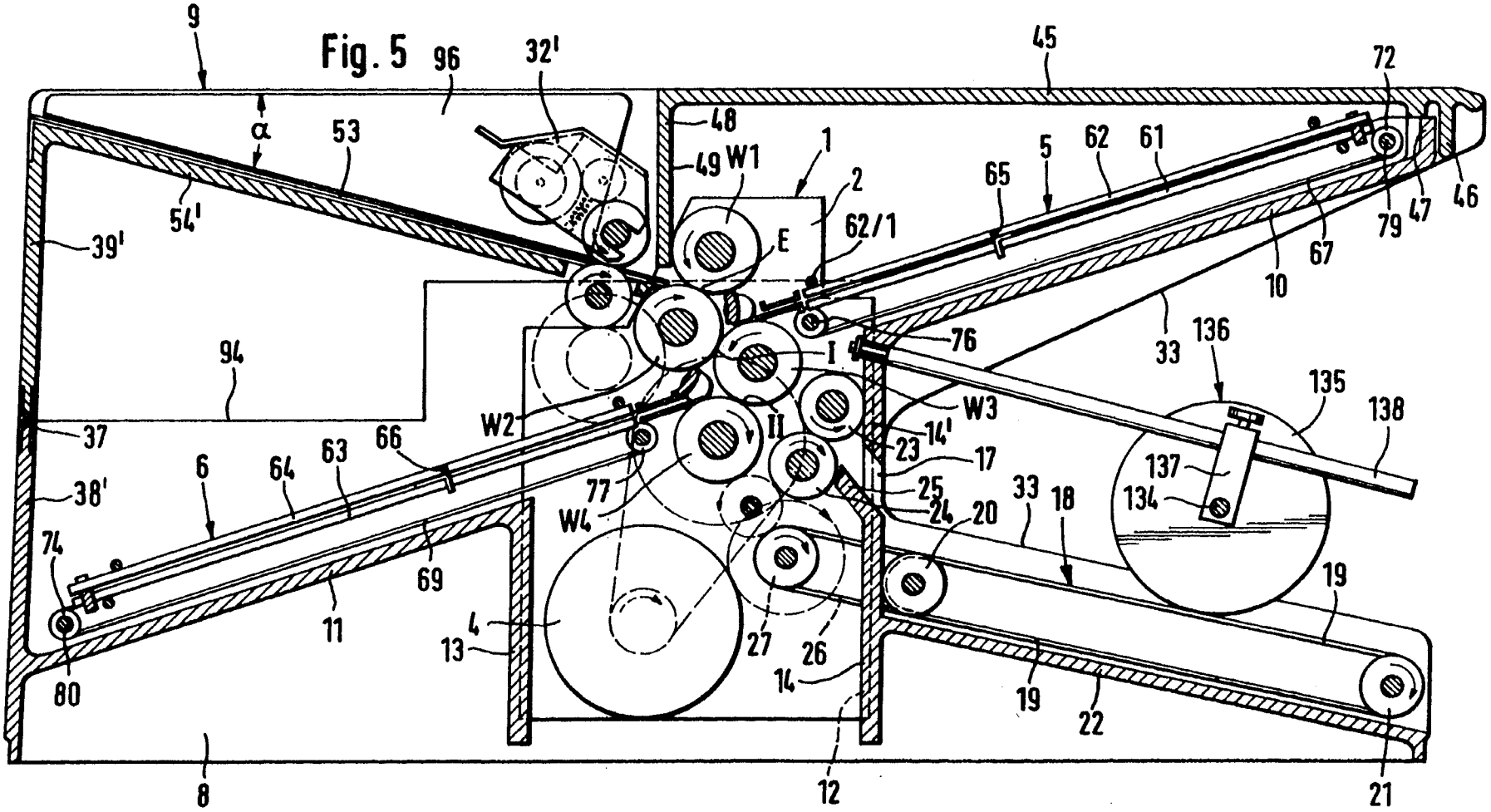
FIG. 5 is a view similar to FIG. 4, of a machine with another feed table and another design for the discharge opening.
Figure 6:
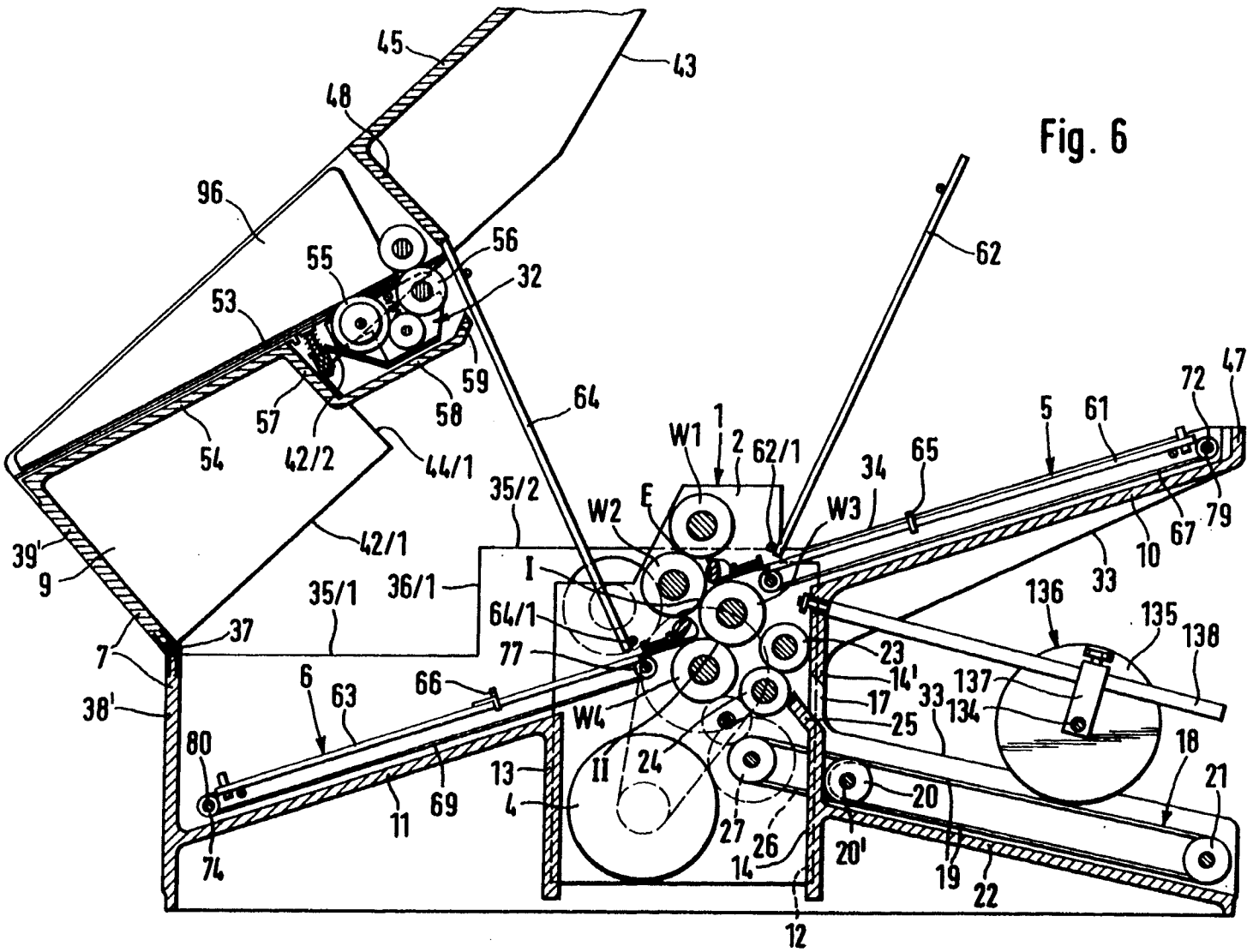
FIG. 6 is a view similar to FIG. 2 of still another embodiment of the machine of FIG. 1, with the cover partly swung up and open folding pockets.
Figure 7:
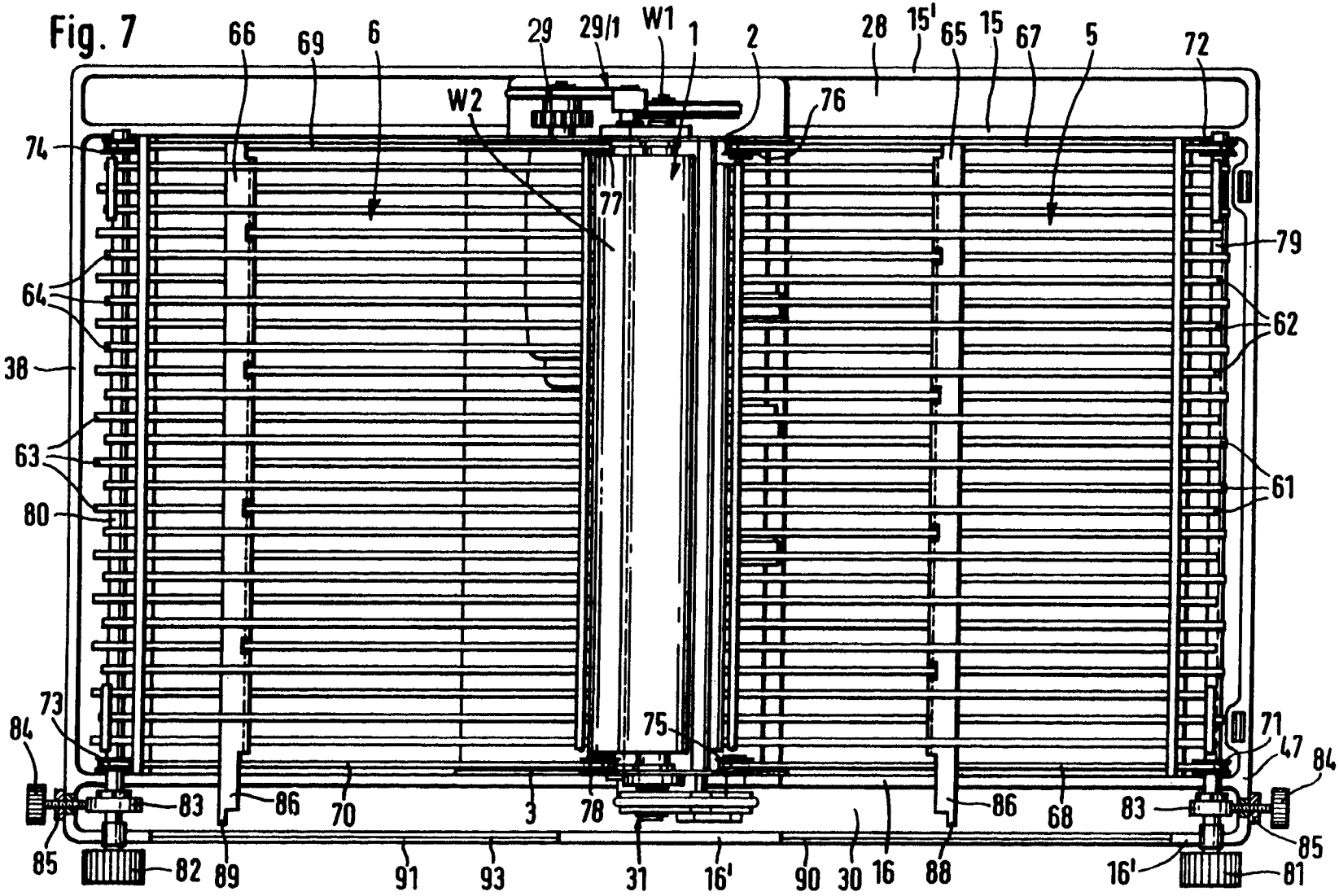
FIG. 7 is a top plan view of a machine of FIG. 2, with the cover removed.

In all the embodiments of FIGS. 1–7, the folder comprises a cylinder frame 1 between two metal plates 2 and 3, supporting a cylinder assembly and, an electric motor 4, and accommodated together with two folding pockets 5, 6 in a common two-part housing 7. Housing 7 comprises a base 8 and a cover 9. To mount the cylinder frame 1, base 8 is designed with a box-like compartment 12 which is provided between two bottom walls 10,11 of the folding pockets 5,6 and mounted at its front and rear by walls 13 and 14 (FIGS. 2,3,5,6). With cover 9 swung open,the cylinder frame 1 can be inserted into this compartment 12 in the way indicated in FIG. 3, from above downwardly. The two folding pockets 5,6 extend at different levels but with the same inclination close above the two bottom walls 10, 11. In this position, they can be secured in place, particularly to vertical intermediate walls 15,16 (FIG. 7). In the same way, folding cylinder pairs W1/W2 and W3/W4 are mounted obliquely above each other. Folding cylinders W2 and W3 form the first folding line I, and folding cylinders W3 and W4 form the second and last folding line II. Folding cylinder W1 and folding cylinder W2 which are in contact with each other, form an intake line E through which a sheet, taken into the housing, is guided either to folding pocket 5 or directly to folding line I. In the wall 14 bounding compartment 12 at the rear side, an obliquely downwardly directed discharge opening 17 is provided through which the folded sheets pass to conveying means 18 which is provided below bottom wall 10 of first folding pocket 5, downwardly of discharge opening 17, conveying means 18 comprises a plurality of endless belts 19 which are trained about a number of rollers 20, 21. Beneath conveying means 18, another bottom wall 22 is provided extending parallel thereto and serving, in addition to front and rear walls 13,14 as a brace, making the base more stable. As shown in FIG. 2, the inside of a wall portion 14' of rear wall 14 extending above discharge opening 17 is provided in close vicinity to the cylindrical surface of a conveying roller 23 which cooperates with another conveying roller 24 to form the advancing pair of rollers disposed between second folding line II and discharge opening 17. The portion below discharge opening 17 of front wall 14 includes a wall portion 25 which faces second conveying roller 24 and, terminates closely adjacent the cylindrical surface of conveying roller 24. This makes sure that no strong noise emission can pass out of the housing through discharge opening 17.

To drive rollers 20 of the conveying means 18, carried on a common shaft 20', a belt 26 is provided by which connection is established through a pulley 27 and a gearing to the cylinder mechanism which is driven by electric motor 4. Bolt 26 and pulley 27 are mounted in an intermediate space 28, which is formed between inner wall 15 and a vertical outer side wall 15'. This intermediate space 28 accommodates still other transmission parts 29, needed for the drive of cylinders W1 to W4 (see FIG. 7). At the opposite side, an intermediate space 30 is provided between wall 16 and an outer vertical housing wall 16'. Further transmission parts 31 of cylinder frame 1 are provided in this space 30 which are needed for driving a sheet feeder 32, 32' (FIGS. 2–6) described hereinafter.

To provide lateral boundaries for the conveying means 18, intermediate and outer walls 15/15', 16/16' extend slightly above upper sections of belts 19, yet form a triangular recess 33 in this zone. Through this recess 33, the discharge opening 17 and thus the sheets coming out of the machine can well be inspected and are directly accessible.

Also provided is a braking mechanism 136 comprising braking disc 135 secured to a common shaft 134, which is supported on a bar 138 for displacement by means of a bracket 137. By means of this braking mechanism, the folded sheets arriving at conveying belts 19 one after the other may be gathered up in overlapping scale-like fashion. Such arrangements are known per se.

Figure 3:
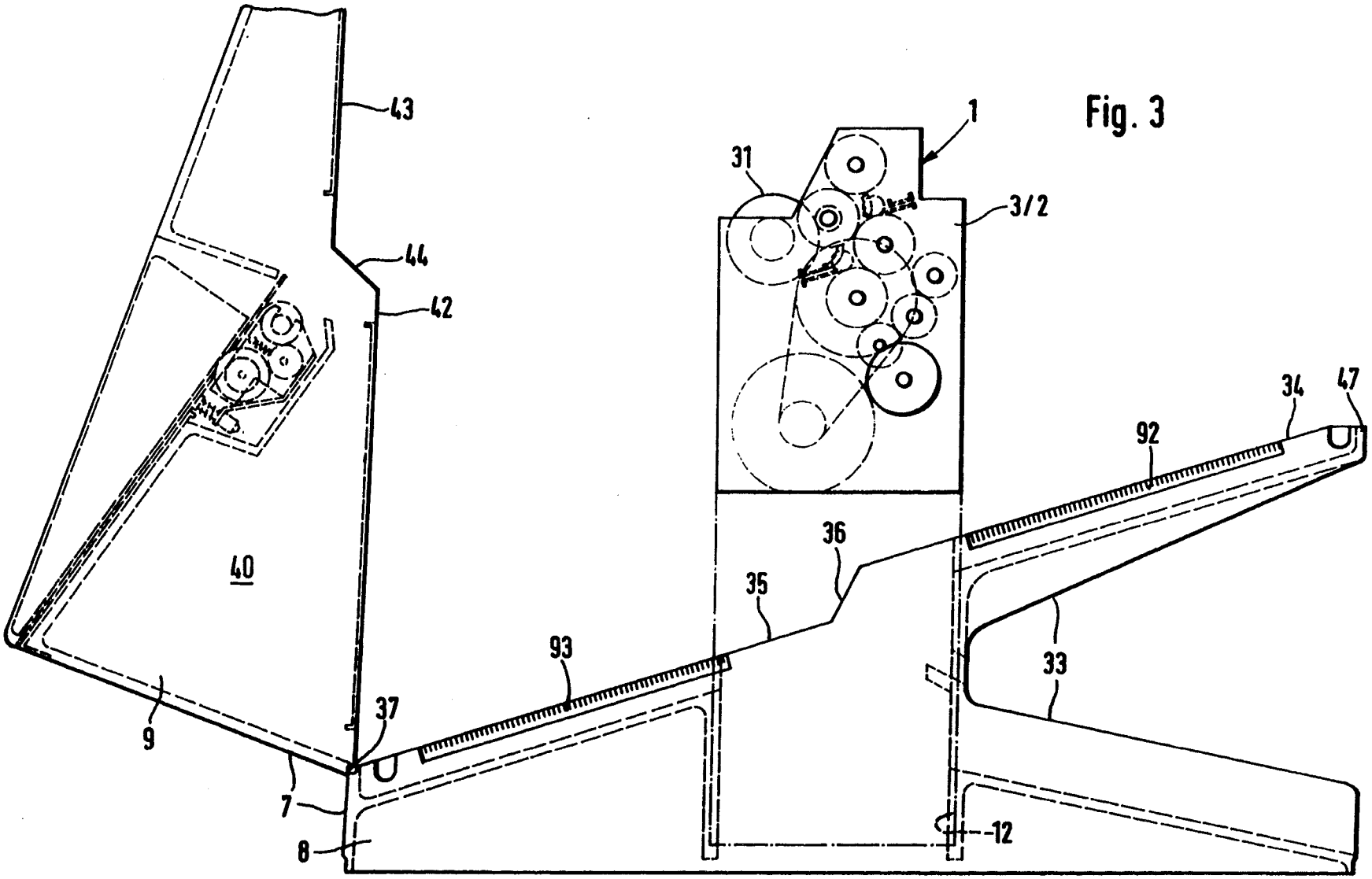
FIG. 3 is a fragmentary side view of the same machine, with the housing swung open and the cylinder frame in a removed position.

In the embodiment of FIGS. 2 and 3, the upper edge 54, 35 of vertical side walls 15/15', 16/16' of base 8 extend parallel to folding pockets 5,6, thus in two vertically offset parallel planes and are connected by an oblique central portion 36. Cover 9 is hinged on the lower end of edge 35 by a hinge connection 37 to base 8. Hinge 37 is provided on a vertical portion 38 of base 8 and connects this portion to a front wall 39 of cover 9. Cover 9 also has two side walls 40, 41 having lower edges 43,43 conformable to edges 34, 35 of base 8, so that these edges as well as the central portions 36,44 apply sealingly against each other.

Figure 4:
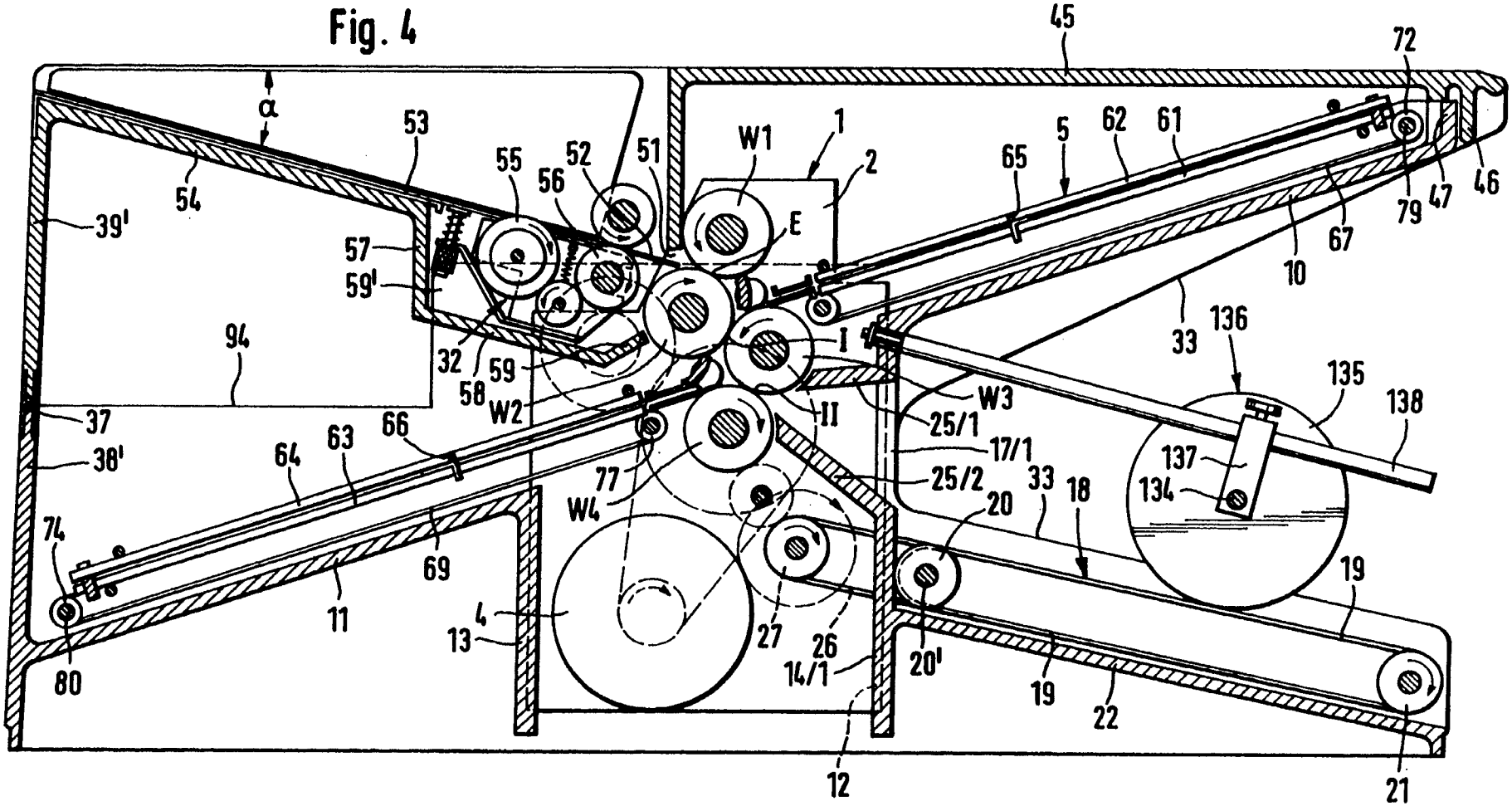
FIG. 4 is a vertical sectional view of another embodiment of the machine of FIG. 1.

Extending between vertical side walls 40, 41 at the side remote from the hinge, is a cover wall 45 which, with the cover closed, extends horizontally and covers the upper, i.e. first folding pocket 5. On its outer end, cover wall 45 is provided with a closing strip 46 by which, in its closed position, the upwardly extending edge strip 47 of bottom 10 of base 8 is engaged, as shown in FIGS. 4 and 5. About in the middle of the housing, a wall portion 48 extends at right angles downwardly from cover wall 45, at such a location that in the closed position, its inner surface 49 is almost in contact with the cylindrical surface of cylinder W1 (see FIGS. 4,5). The lower edge 50 of this wall portion 48 which at the same time forms the upper boundary edge of intake opening 51, extends in this position close to intake line E which is formed between cylinders El, W2, and close above the downstream end 52 of a feed table 53 which is equipped with the mentioned sheet feeder 32.

In the cover portion at the hinge side, a second cover wall 54 is provided forming an angle α of about 15° with the plane of cover wall 45, and extending in a manner such that feed table 53, which is supported thereon is directed exactly at intake line E (see FIGS. 4,5).

It is possible, in order to avoid too large an intake opening 51, to provide the downstream end of feed table 53 closely adjacent the circumference of cylinder W2. Because of the unavoidable passage openings which must be provided for conveying rollers 55, 56 in feed table 53 which is usually a metal plate, to prevent an eccessive noise emission, cover wall 54 is provided in the zone of sheet separator 32 with wall portions 57,58 forming a trough-like recess 59', with (in the closed position) the end edge of portion 59 extending closely adjacent the circumference of folding cylinder W2.

Another particular feature of this embodiment of FIGS. 2 and 3, is that two closely spaced apart rod lattices 61, 62, 63, 64 are mounted separately. Rod lattices 61 and 63 are secured to base 8, while upper rod lattices 62, 64 are secured to cover 9, between side walls 40, 41 and in a manner such that in the closed position of cover 9, they form as is usual, the upper half of folding pockets 5,6. This arrangement has the advantage that by opening cover 9, the folding pockets are automatically opened and made accessible.

Between rod lattices 61 to 64 of either of the folding pockets, a stop rail 65,66 is provided which is connected to the lower lattices 61,63 and displaceable thereon. To be able to adjust these stop rails 65,66 to the desired position with the housing 7 closed, thus from the outside, stop rails 65,66 are secured each to two endless cog belts 67 to 70 (see also FIG. 7), which are provided at either side of the respective folding pocket 5,6. Cog belts 67 to 70 are trained about drive rollers 71 to 74 and tail rollers 75 to 78. Two pairs of drive rollers 71 to 74 are non-rotatably secured to common drive shafts 79, 80 which are mounted for rotation at the outer end of the respective folding pocket 5,6 on base 9, and are provided with a turning knob 81, 82. As shown in FIGS. 1 and 7, knobs 81, 82 are provided at the outside of outer wall 16' of base 8. Drive rollers 71 to 74, tail rollers 75 to 78, and cog belts 67 to 70 are so arranged that the upper sections of belts 67 to 70 extend parallel to the plane in which stop rails 65,66 are displaceable in folding pockets 5,6. The stop rails may thus be displaced by simply turning knobs 81, 82 in one or the other direction.

To be able to arrest stop rails 65,66 in the once selected position, i.e. prevent their unintentional displacement, drive shafts 79, 80 are equipped each with a fixing mechanism. This mechanism comprises a disc 83 which is non-rotatably secured to the drive shaft, and a knurled screw 84 which can be screwed through a tap hole of a bushing 85 provided in the strip 47 or in wall portion 38 of base 8, and pressed against the cylindrical surface of disc 83, to fix the shaft in position. With the knurled screws loosened, drive shaft 79, 80 can be rotated easily.

To be able also to control the position of the two stop rails 65,66 from the outside, thus with housing 9 closed, both stop rails 65,66 are provided with extension 86 carrying positioning pointers 88, 89 on their ends, which project close to the inside of outer vertical housing wall 16'. Alongside the path of motion of pointers 88,89, positioning scales in the form of transparent graduated rules are provided in window-like recesses 90,91 of outer side wall 16', as shown in FIGS. 1, 3 and 7.

The embodiments of FIGS. 4,5 and 6 differ from those of FIGS. 1, 2 and 3 in that the parting line between base 8 and cover 9 in the left hand part of the housing extends partly horizontally and partly vertically, not in parallel to folding pocket 6. Only in the zone of folding pocket 5, the parting line extends as in the embodiment of FIGS. 2 and 3. Parting line 94 is formed on base 8 by two upper horizontal edges 35/1, 35/2 and a vertical edge 36/1 therebetween, and , in the zone of folding pocket 5, by upper edge 34. On the cover, the parting line is formed by horizontal lower edges 42/1, 42/2, vertical edge 44/1 therebetweeen and the oblique edge 43. Another difference is that in the embodiments of FIGS. 4,5 and 6, the upper rod lattices 63,64 of folding pockets 5,6 are mounted in cylinder frame 1 for being swung open by means of transverse rods 62/2 and 62/1 provided at the intake sides of the pockets, so that with cover 9 swung up, folding pockets 5,6 can be opened, as indicated in FIG. 6.

While in the embodiments of FIGS. 5 and 6, rear wall 14 and discharge opening 17 are of the same design as in the embodiment of FIG. 2, in the embodiment of FIG. 4, another discharge opening 17/1 is provided in a rear wall 14/1, namely an opening formed by two wall portions 25/1, 25/2 which extend inwardly and terminate close to cylinders W3, W4. In this embodiment, conveying rollers 23, 24 may be omitted.

Unlike the embodiments of FIGS. 2,3,4 and 6, the embodiment of FIG. 5 provides a sheet intake mechanism 32' above feed table 53, and for this reason, sloping wall 54 of cover 9 is not formed with a trough but extends as a wall 54' straight up to folding cylinder W2. Otherwise, the embodiment of FIG. 5 is identical with that of FIG. 6.

In all the embodiments, transmission members 31 are provided in cylinder frame 1, through which, in the closed position of cover 9, sheet feeders 32, 32' are driven from the cylinder mechanism.

Again in all of the embodiments, feed table 53 is provided with lateral guide walls 95, 96.

In contradistinction to the shapes of the base and the cover shown in FIGS. 2 to 6, FIG. 1 shows still another modification of the shape in which the oblique parting line 97 between the cover and the base is straight throughout. This is another embodiment of the housing which, however, requires a correspondingly modified positioning of the pairs of the folding cylinders and the folding pockets.

While specific embodiments of the invention have been shown and described in detail to illustrate the application of the principles of the invention, it will be understood that the invention may be embodied otherwise without departing from such principles.

What is claimed is:

1. A buckling-type folding machine comprising:

a cylinder frame;

a plurality of folding cylinders rotatably mounted to said frame for moving a sheet to be folded in a sheet path;

first folding pocket means mounted for receiving a sheet on one side of said frame;

second folding pocket means mounted on an opposite side of said frame and at a vertical level different from a level of said first folding pocket means;

each of said first and second folding pocket means including a bottom wall and a displaceable sheet stop movable to establish a position at which a sheet fed by said plurality of rollers is stopped in respective pocket of said first and second pocket means;

a housing substantially surrounding said first and second pocket means and said cylinder frame;

said housing comprising a base which includes said bottom walls of said first and second folding pocket means, a box-like compartment defined between said bottom walls shaped to receive said cylinder frame, said cylinder frame disposed in said box-like compartment, said base including two lateral vertical walls between which said cylinder frame is disposed, said lateral vertical walls having upper edges;

said housing also comprising a cover removably mounted to said base and defining a space with said base for substantially surrounding said cylinder frame and said first and second folding pocket means, said cover comprising a first cover wall extending above said first folding pocket means and including a wall portion projecting toward said cylinder frame and defining an upper edge of an intake opening into said space, said cover including a second cover wall extending over said second folding pocket means and defining a lower edge of said intake opening, said cover including a front wall connected to said second cover wall and extending downwardly of said second cover wall to said base, said cover including two lateral vertical side walls having lower edges engageable with said upper edges of said base and defining with said upper edges a parting line between said base and cover with said space closed, said parting line extending at least partly on a plane of a pocket of one of said first and second folding pocket means.

2. A machine according to claim 1, wherein said base has a front wall extending to said front wall of said cover, and a hinge connected between said cover and base front walls for pivotally connecting said cover to said base.

3. A machine according to claim 1, wherein said upper and lower edges of said intake opening which are defined by said wall portion and second cover wall of said cover, extending substantially to a circumferential surface of at least one of said folding cylinders at an upstream end of said sheet path.

4. A machine according to claim 3, wherein said base includes an interior front wall projecting downwardly from said bottom wall of said second folding pocket means and an interior rear wall extending downwardly from said bottom wall of said first folding pocket means, said interior front and rear walls being spaced apart with said cylinder frame disposed therebetween, said interior rear wall having at least one inclined portion defining a discharge opening from said compartment, said inclined portion extending substantially to a circumference of at least one of said cylinders of said cylinder frame at a downstream end of said sheet path.

5. A machine according to claim 1, wherein said second cover wall of said cover slopes downwardly to said intake opening and defines a feed table for sheets to be supplied to said intake opening.

6. A machine according to claim 5, wherein said second cover wall includes a trough-like recess, with a sheet feeder disposed in said recess for feeding sheets to said intake opening.

7. A machine according to claim 1, wherein said bottom walls of said first and second folding pocket means extend approximately at equal angles to a horizontal plane and toward said cylinder frame, said bottom wall of said first folding pocket means extending upwardly from said frame and said bottom wall of said second folding pocket means extending downwardly from said frame.

8. A machine according to claim 1, wherein said base includes an interior rear wall bounding one side of said compartment extending downwardly from said bottom wall of said first folding pocket means, said interior rear wall defining a discharge opening therein for receiving sheets from said sheet path.

9. A machine according to claim 8, wherein said interior rear wall includes two spaced apart wall portions inclined toward an interior of said compartment and defining said discharge opening, said wall portions extending substantially to a cylindrical surface of two folding cylinders forming a last folding line at a downstream end of said sheet path.

10. A machine according to claim 1, wherein said compartment includes a discharge opening, conveying means mounted on said base downstream of said discharge opening with respect to said sheet path for conveying sheets from said discharge opening, said base including a housing bottom extending parallel to and below said conveying means.

11. A machine according to claim 1, wherein each of said pockets comprises pairs of sets of spaced apart rod lattices extending parallel one above the other and defining a pocket therebetween,said stop rail of each of said first and second folding pocket means being connected to one of said sets of rod lattices.

12. A machine according to claim 10, wherein one of said sets of rod lattices of each pair for defining each pocket is connected to said cover, the other set of rod lattices being connected to said base.

13. A machine according to claim 1, including endless belt means connected to each stop rail of said first and second folding pocket means, a pair of rollers for mounting each endless belt means for movement to move each stop rail, and a turning member connected to at least one roller of each pair said turning member being accessible from an exterior of said space and turnable to move a respective stop rail.

14. A machine according to claim 13, wherein said base includes a window recess adjacent the pocket of each of said first and second folding pocket means, each stop rail having pointer connected thereto and viewable through said window recess for indicating a position of each stop rail from an exterior of said housing.

15. A machine according to claim 13, including a shaft connected to said rollers and brake means engageable with a shaft of each stop rail for fixing a position of each stop rail.

16. A machine according to claim 1, wherein at least one of said two lateral side walls of said base include a recess therein below said bottom wall of said first folding pocket means, and conveying means connected to said base for conveying a sheet away from said cylinder frame, said conveying means being disposed below said recess.

* * * * *